US007487617B2

(12) United States Patent
Hockman

(10) Patent No.: US 7,487,617 B2
(45) **Date of Patent: *Feb. 10, 2009**

(54) SNOW GUARD ASSEMBLY

(76) Inventor: Mark Hockman, c/o Snow Meister, Box 586, Westtown, PA (US) 19395

( * ) Notice: Subject to any disclaimer, the term of this patent is extended or adjusted under 35 U.S.C. 154(b) by 564 days.

This patent is subject to a terminal disclaimer.

(21) Appl. No.: 10/784,812

(22) Filed: Feb. 24, 2004

(65) Prior Publication Data

US 2005/0193649 A1 Sep. 8, 2005

(51) Int. Cl.
*E04D 13/10* (2006.01)

(52) U.S. Cl. ..... 52/25; 52/24; 52/26; 248/535; 403/388; 403/396

(58) Field of Classification Search ..... 52/24–26, 52/698, 543, 545, 537, 462–463, 478, 547, 52/548; 248/512, 535; 403/362, 388, 396, 403/368

See application file for complete search history.

(56) References Cited

U.S. PATENT DOCUMENTS

| | | | | |
|---|---|---|---|---|
| 595,295 | A | 12/1897 | Fox et al. | |
| 1,095,822 | A | 5/1914 | Danzer | |
| 1,330,309 | A | 2/1920 | Dixon | |
| 4,141,182 | A | 2/1979 | McMullen | |
| 4,593,877 | A * | 6/1986 | van der Wyk | 248/512 |
| 5,152,107 | A | 10/1992 | Strickert | |
| 5,222,340 | A | 6/1993 | Bellem | |
| 5,271,194 | A | 12/1993 | Drew | |
| 5,282,340 | A | 2/1994 | Cline et al. | |
| 5,343,659 | A | 9/1994 | Zaleski | |
| D351,989 | S | 11/1994 | Cline et al. | |
| 5,371,979 | A | 12/1994 | Kwiatkowski et al. | |
| D364,338 | S | 11/1995 | Cline | |
| 5,483,772 | A | 1/1996 | Haddock | |
| 5,522,185 | A | 6/1996 | Cline | |
| 5,570,557 | A | 11/1996 | Kwiatkowski et al. | |
| 5,613,328 | A | 3/1997 | Alley | |
| 5,664,374 | A | 9/1997 | Lee | |
| 5,694,721 | A | 12/1997 | Haddock | |
| 5,711,114 | A | 1/1998 | Mueller | |
| 5,715,640 | A | 2/1998 | Haddock | |
| 5,732,513 | A | 3/1998 | Alley | |
| 6,499,259 | B1 * | 12/2002 | Hockman | 52/26 |
| 6,536,166 | B1 * | 3/2003 | Alley | 52/25 |

OTHER PUBLICATIONS

Publication: www.polarblox.com, Polar Blox Standing Seam Guards, 2002.

* cited by examiner

*Primary Examiner*—Jeanette Chapman
(74) *Attorney, Agent, or Firm*—William E. Jackson; Stites & Harbison PLLC

(57) ABSTRACT

A decorative snow guard assembly attachable to raised portions of a building surface such as a standing seam roof. The assembly includes a decorative snow brake plate integral with a base, means spanning between adjacent bases, and means connecting said spanning means to said bases.

6 Claims, 6 Drawing Sheets

SNOW GUARD ASSEMBLY

FIELD OF THE INVENTION

The present invention generally relates to a decorative snow guard assembly which is attachable to raised portions of a building surface (e.g., roof).

BACKGROUND OF THE INVENTION

With the increased use of sheet metal panels in building construction, there has been an increased need to address ways in which various building attachments can be interconnected with a metal panel surface. For example, in the case of metal roofs, there is often a need to mount/secure various types of equipments thereon. Specifically, in various climates, it may be desirable to position a snow retention device on a metal roof to control/inhibit/impede the movement of snow and/or ice down the pitch of the roof.

Sliding snow and/or ice from metal roofs can be hazardous to people, the surrounding landscape, property, and building components. For example, snow or ice sliding from a roof above an entryway may injure passersby. Similarly, falling snow or ice can do damage to landscape features, such as shrubs, and property or building components, including automobiles or lower roofing portions. In addition, sliding snow or ice can shear off antennas, gutters or other components attached to a building roof or wall, thereby potentially causing a leak. The problem of sliding snow or ice is particularly experienced in connection with metal roofs, including raised seam roofs, (e.g., standing seam) where there is relatively little friction between the roof and the snow or ice.

Numerous snow guard devices have been developed and used in the prior art. However, there are a number of problems generally associated with one or more of the snow guard devices. For example, such devices may cause the roof to leak. Many of the prior art devices are attached to roof by a screw, nail, or other fastener which pierces the roofing surface. Such piercing of the roof can lead to undesirable leakage due to inadequate sealing or shearing of the fastener by the forces exerted thereon by sliding snow and/or ice. Alternate methods for attachment of snow guard devices to roofs such as adhesive bonding may fail to provide secure attachment and/or may be difficult to install on a sloped surface, particularly where the device is applied to a smooth non-porous roofing material such as metal.

Many known snow guard devices can also cause undesirable pinning of the roof materials. Metal roofing sheets are often designed to be movable so as to accommodate normal thermal expansions and contractions. Where snow guard devices in the prior art are attached to the roof by a screw, nail or the like, which pierces the roof surface and is anchored to an underlying structural member or deck, the design thermal movement characteristics of the roof can be compromised thereby adversely effecting the roofs performance. Based upon the foregoing, it is apparent there is a need for a mounting device for a decorative snow guard which may be positioned on a metal panel surface without adversely effecting its performance.

SUMMARY OF THE INVENTION

The present invention is generally directed toward to an improvement in the combination of a metal standing seam roof and a decorative snow guard assembly. The present invention is also generally directed to a method of mounting a decorative snow guard assembly on a roofing surface having a downward slope.

In one aspect of the present invention, the combination of a metal raised seam roof and a snow guard assembly is involved. The roof comprises a first roofing panel and a second roofing panel, each of the panels having a substantially perpendicular longitudinal edge thereon. The longitudinal edge of the first panel is positioned in close proximity to the longitudinal edge of the second roofing panel thereby forming a raised seam therealong. The snow guard assembly of the present invention comprises a decorative snow brake plate and an integral base. The base defines a groove whereby the base is locatable on the metal roof by placement of the groove about a segment of the seam. The snow guard assembly also comprises spanning means extending between adjacent snow brakes and means mounted on said snow brake base for connecting the base with said spanning means.

According to another aspect of the present invention, the decorative snow brake plate and integral base are formed out of metal and the base has integral depressions or bosses extending outwardly from the outer surfaces. The integral depressions or bosses are located near the surface of the roof whereby the spanning means is connectable to the bosses on adjacent snow brakes.

According to still another aspect of the present invention, the spanning means are fabricated from pipe wherein the hollow ends of the pipe slidably fit over the bosses or into the depressions formed on the snow brake base.

According to the method aspect of the present invention, a method of mounting a decorative snow guard assembly on a roofing surface having a downward slope in a direction from an elevated portion of said roof surface toward an edge of said roofing surface is provided. According to the method, the roofing surface has first and second displaced raised portions thereon (such as seams) with at least one base portion therebetween. The method comprises the steps of providing a first snow guard interconnected with the first raised portion of the roofing surface. The first snow guard has a base which defines a groove whereby said base is locatable about a segment of the first raised roof portion. The base also has an integral boss extending from the side of the base adjacent to the roofing surface. The method involves providing a pre-cut pipe which is dimensioned to extend between the raised portions of the roof. The method further involves inserting one end of the pipe over the boss on the snow brake base applied to one seam. The method further involves providing a second snow guard, that snow guard having a base defining a groove and an integral boss extending from the side of the base adjacent to the roofing surface. According to the method, the other end of said pipe is inserted over said boss. Thereafter, the groove formed in the snow brake base of the second snow guard is located about a segment of said second raised roof portion. The end result of the present invention is that the pipe is mounted parallel to the surface of the roof and below the height of the raised portions of the roof.

These and further and objects and features of the present invention are apparent in the disclosure, which includes the above and the written specification, claims and drawings referenced below.

DESCRIPTION OF THE PREFERRED EMBODIMENTS

Figure 1:
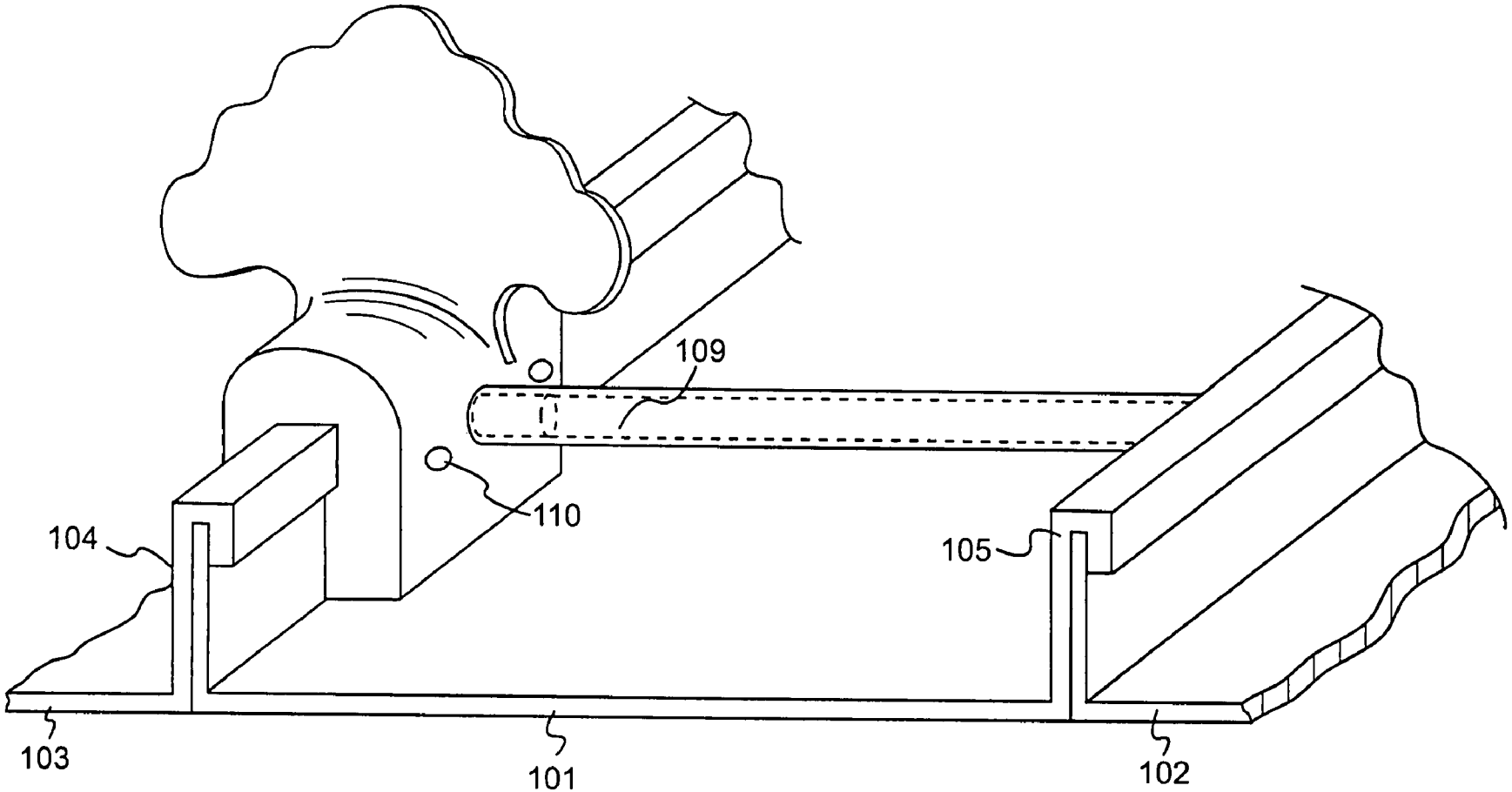
FIG. 1 is an orthogonal view of the present invention illustrating the combination of a metal standing seam roof and a snow guard assembly.

Turning to FIG. 1, an orthogonal view of the present invention used in conjunction with a snow guard assembly mounted on a metal roof is illustrated.

The metal roof comprises a plurality of metal roofing panels such as 101, 102 and 103. The longitudinal length of each panel preferably is contiguous to cover the span of the roof section. A plurality of roofing panels are laid side-by-side to cover the width of a roof section.

Each panel includes substantially perpendicular edges running along both the left and right hand sides thereof and the roofing panels are located such that their substantially perpendicular edges are abutting, thereby forming a seam therebetween.

The substantially perpendicular edges of the abutting panels are each typically crimped together and/or bent downwardly over each other to form a joint such as 104 and 105. The joint seals the adjoining panels, thereby preventing fluid communication to the roofing substructure below the roofing panels, as well as to the area between each roofing panel. Such fluid communication to the substructure could lead to the substructure becoming rotted, infested or otherwise losing or degrading its structural and integrity. The raised seam between panels can have various configurations including a rolled seam of various configurations, among other forms.

The snow guard assembly comprises a decorative snow brake plate 106 integral with a base 107. The snow brake base 107 defines a groove 108 whereby the base is locatable on the metal roof by placement of the groove about a segment of the seam. The dimensions of groove 108 may take many shapes and are not limited to those shown in the drawings illustrative of the present invention.

Figure 3:
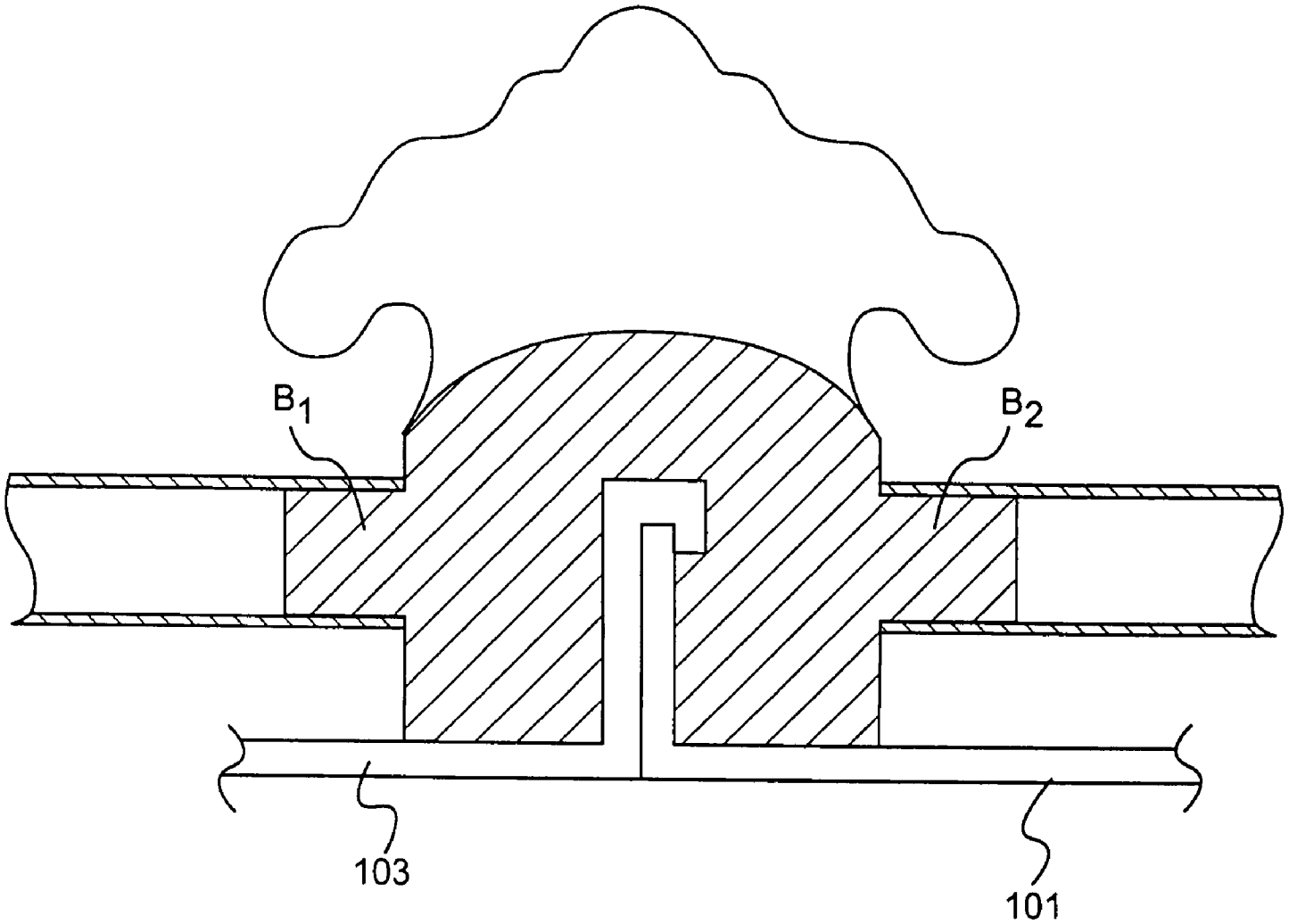
FIG. 3 is a partial cross section of the device shown in FIG. 1.

A partial cross-sectional view of FIG. 1 is illustrated in FIG. 3 which shows bosses $B_1$, $B_2$ formed at the side portions of the snow brake base 107. The bosses $B_1$ and $B_2$ are formed close enough to the bottom of the snow brake base 107 so that the interconnected pipes 109 are located between the rolled seams. Thus, the pipe 109 is located close enough to the roofing surface to block the passage of snow and ice but far enough away to allow for melting snow or rain water to pass beneath the pipe 109. It should be understood that the shape of pipes 109 may be varied within the present invention. For example, the pipe may have a rectangular cross section.

As shown in FIG. 3, the substantially perpendicular edge of roofing panel 103 is adjacent the substantially perpendicular edge of roofing panel 101, thereby forming a seam 104 therealong, with the top portions thereof folded over to prevent fluid communication to the roofing substructure below the roofing panels, as well as to the area between each roofing panel.

Figure 5:
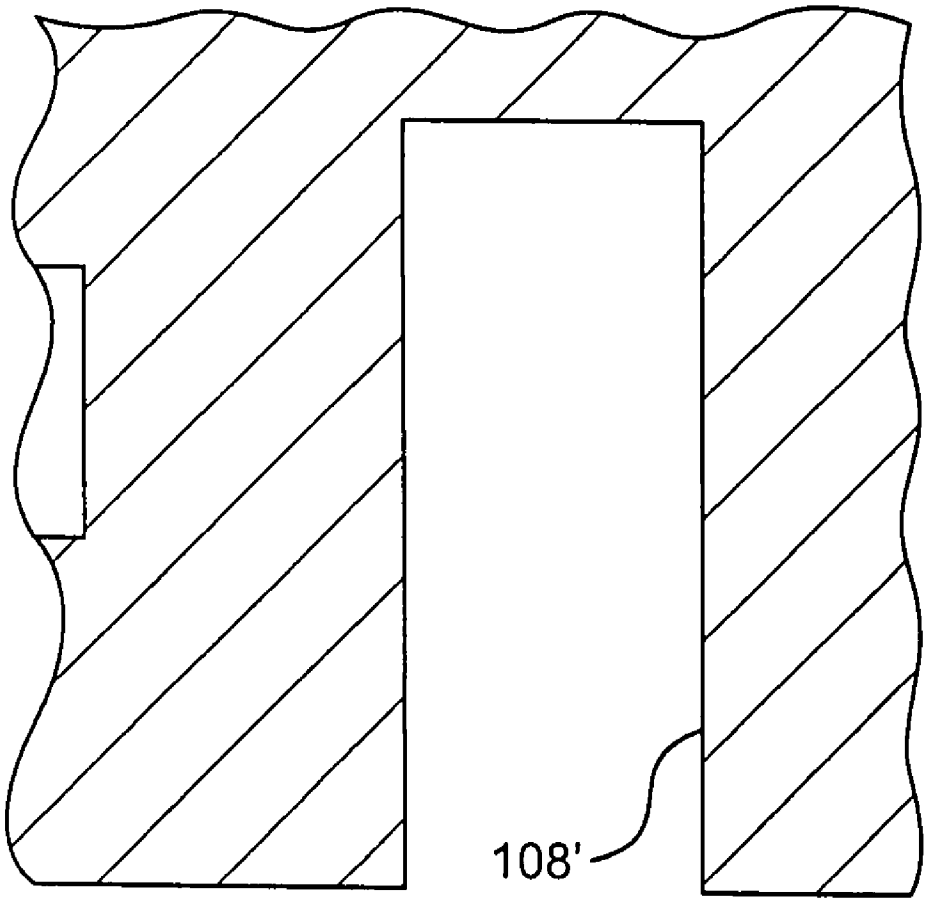
FIG. 5 is a partial cross section of the base of a snow guard with a modification of the groove for placement on a standing seam.

Set screws shown schematically at 110 are preferably driven into threaded holes and contact a portion of the seam. As shown in FIG. 3, the interior surface of the groove defined by the snow brake base is stepped so as to interlock below the lowest portion of the rolled seam 104 of the standing seam roof portion. While the specific method of attaching the snow brake base to the standing seam can take different forms, the disclosed embodiment is particularly effective. The disclosed embodiment is described in detail in Applicant's co-pending patent application Ser. No. 09/693,786, filed Oct. 20, 2000, and entitled "Non-deforming Roof Snow Brake", now U.S. Pat. No. 6,499,259. The disclosure of that application is incorporated herein by reference. An alternate form of attachment may use the groove 108' as shown in FIG. 5.

Figure 2A:
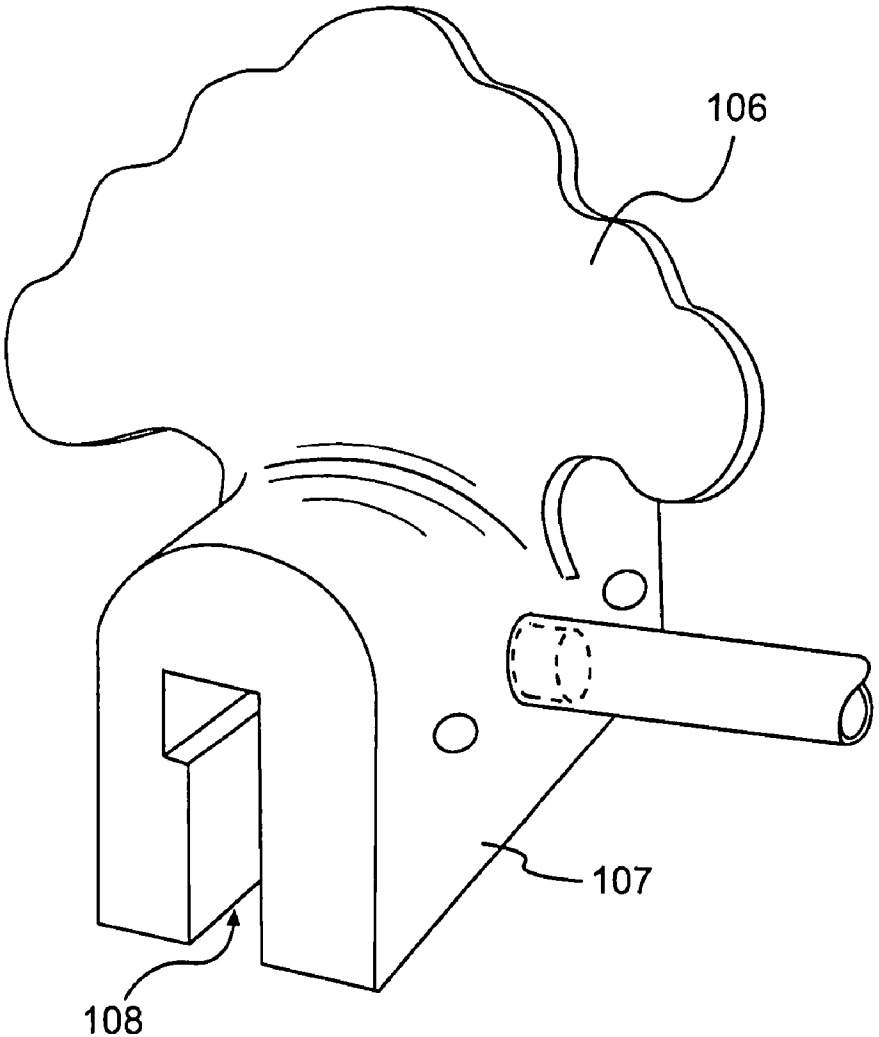
FIG. 2A is an orthogonal view of a snow guard comprising a decorative plate mounted on a snow brake base and including an integral boss according to one aspect of the present invention.
Figure 2B:
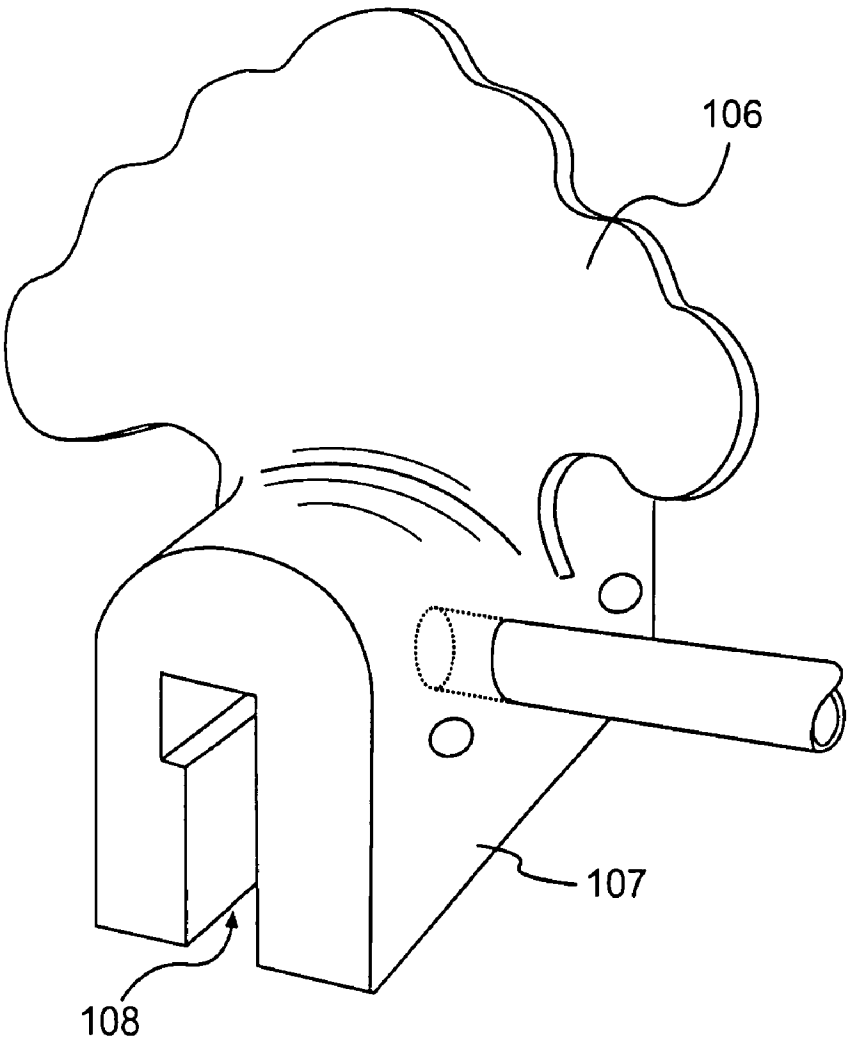
FIG. 2B is an orthogonal view of a snow guard comprising a decorative plate mounted on a snow brake base which defines a depression for the insertion of pipe members according to another aspect of the present invention.
Figure 4:
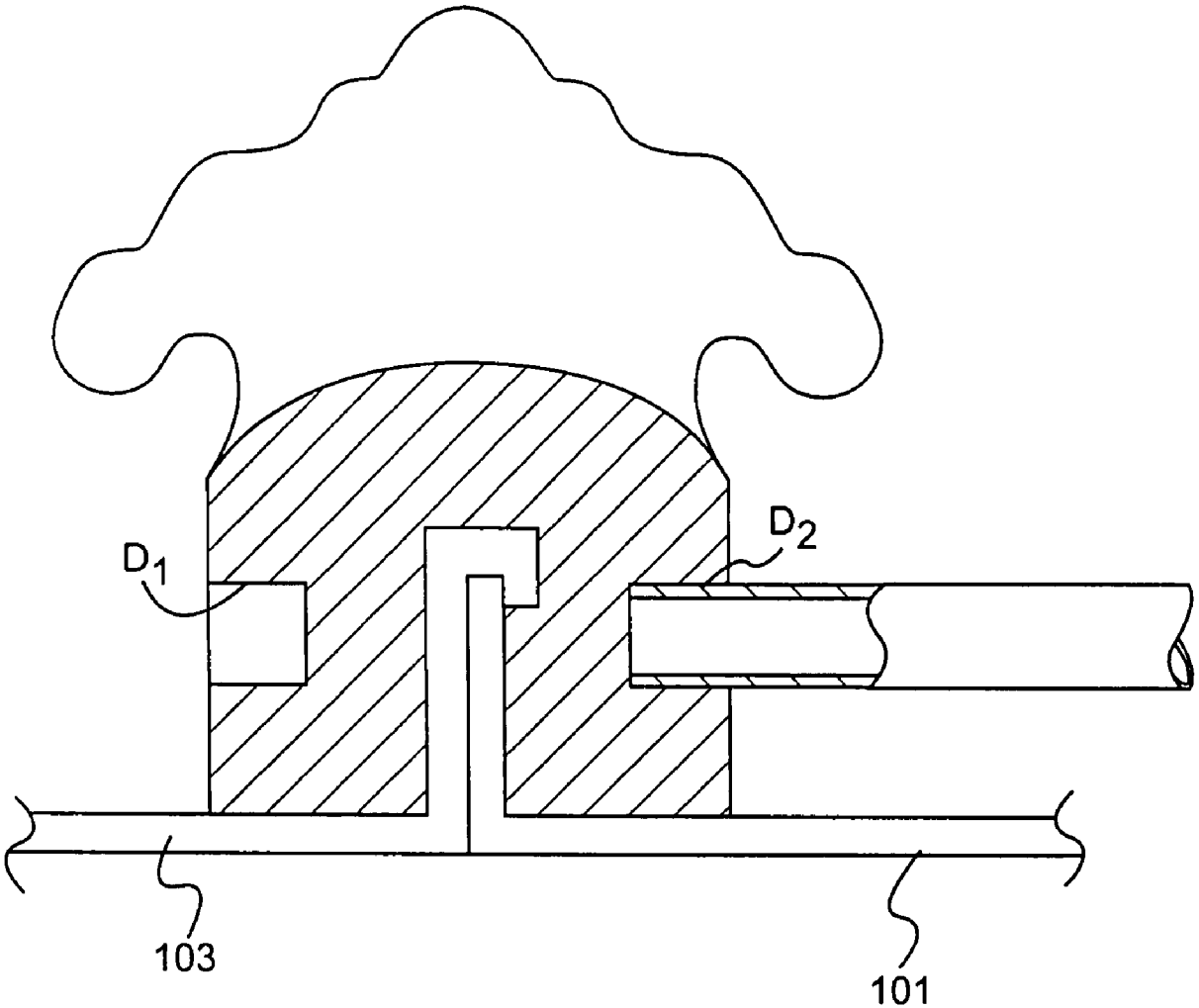
FIG. 4 is a partial cross section of the device shown in FIG. 2B.

FIG. 2B and FIG. 4 illustrate a further embodiment of the present invention wherein depressions $D_1$ and $D_2$ are defined on the sides of the snow brake base 107 and pipes 109 are dimensioned to be inserted into the depressions.

Although illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What is claimed is:

1. In the combination of a metal standing seam roof and a snow guard assembly, said roof comprising a first roofing panel and a second roofing panel, the first and second roofing panels each having a substantially perpendicular longitudinal edge thereon, the longitudinal edge of the first roofing panel positioned in close proximity to the longitudinal edge of the second roofing panel forming a raised seam therealong, said snow guard assembly comprising a decorative fan shaped snow brake plate integral with a base which defines a groove whereby the base is locatable on the metal roof by placement of the groove about a segment of the seam, the improvement comprising:

spanning means extending between adjacent snow brakes, and means on said base for connecting the base with said spanning means, said spanning means and said means for connecting being located below the top of adjacent seams.

2. The invention of claim 1, wherein said base defines a groove that has at least one wall wherein is shaped to interlock with a lower edge of said raised seam.

3. The invention of claim 1, wherein said means on said base for connecting to said spanning means comprises bosses extending outwardly from the outer side surfaces of said base, said bosses being located near the surface of the roofing panel whereby said spanning means is connectable to said bosses on adjacent snow brakes.

4. The invention of claim 3, wherein said spanning means is a pipe wherein the hollow ends of said pipe slidably fit over said bosses on said bases.

5. The invention of claim 1, wherein said means on said base for connecting to said spanning means comprises depressions formed on the outer side surfaces, respectively, of said base.

6. The invention of claim 5, wherein said spanning means fits into said depressions whereby said spanning means is connectable into said depressions on adjacent snow brakes.

* * * * *